US006510856B1

(12) United States Patent
Ahn

(10) Patent No.: US 6,510,856 B1
(45) Date of Patent: Jan. 28, 2003

(54) APPARATUS AND METHOD FOR HAIR EXTENSION

(76) Inventor: Chang H. Ahn, 410 S. Hobart Blvd. #208, Los Angeles, CA (US) 90020

( * ) Notice: Subject to any disclaimer, the term of this patent is extended or adjusted under 35 U.S.C. 154(b) by 7 days.

(21) Appl. No.: 09/686,524

(22) Filed: Oct. 11, 2000

(51) Int. Cl.[7] ..... A45D 24/00; A45D 24/04; A41G 3/00

(52) U.S. Cl. ..... 132/219; 132/126; 132/201

(58) Field of Search ..... 132/219, 126, 132/148, 137, 138, 134, 151, 145, 118, 132, 227, 269, 201; 219/222, 225

(56) References Cited

U.S. PATENT DOCUMENTS

| | | | | | |
|---|---|---|---|---|---|
| 846,813 | A | * | 3/1907 | Weiler | 132/148 |
| 990,314 | A | * | 4/1911 | Taylor | 132/126 |
| 1,666,217 | A | * | 4/1928 | Nancolas | 132/219 |
| 1,852,269 | A | * | 4/1932 | Siers | 132/126 |
| 2,446,424 | A | * | 8/1948 | Kline | 132/148 |
| 4,423,531 | A | * | 1/1984 | Wall | 15/187 |
| 5,400,809 | A | * | 3/1995 | Adams | 132/118 |
| 5,785,064 | A | * | 7/1998 | Simpson | 132/226 |
| 5,865,188 | A | * | 2/1999 | Marquez | 132/132 |

* cited by examiner

*Primary Examiner*—Nicholas D. Lucchesi
*Assistant Examiner*—Robyn Kieu Doan
(74) *Attorney, Agent, or Firm*—Jerry H. Noh

(57) ABSTRACT

An apparatus and method for the attachment of supplemental hair to existing natural hair. The apparatus comprising a first comb member, a handle attached at a back end thereof, and a second comb member hingeably or pivotally attached thereto. A row of first teeth extends from the first comb member corresponding to a row of second teeth extending from the second comb member. The second comb member is positioned to be moveable interchangeably between a closed position and an open position. A heating member connects to and provides heat to one or both of the first comb member and second comb member. The apparatus is utilized in a process to attach supplemental hair to existing natural hair of a person's head. The method uses rows of supplemental hair pre-attached to a band member. An adhesive member is pre-hardened on each row of supplemental hair at a predetermined distance near the band member. With the second comb member in the open position, the rows of supplemental hair strands of natural hair are placed between each tooth of the row of first teeth. The second comb member is moved to the closed position for a predetermined period of time long enough to allow the pre-hardened adhesive to melt sufficiently to adhere the rows of supplemental hairs.

20 Claims, 5 Drawing Sheets

Fig. 7
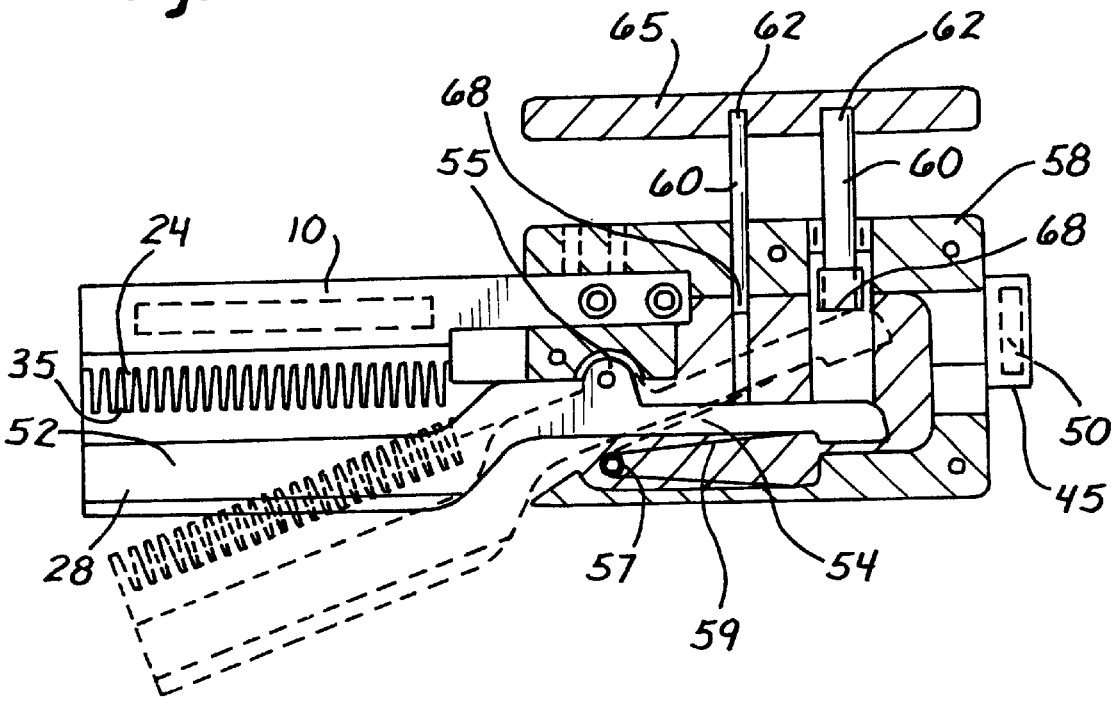
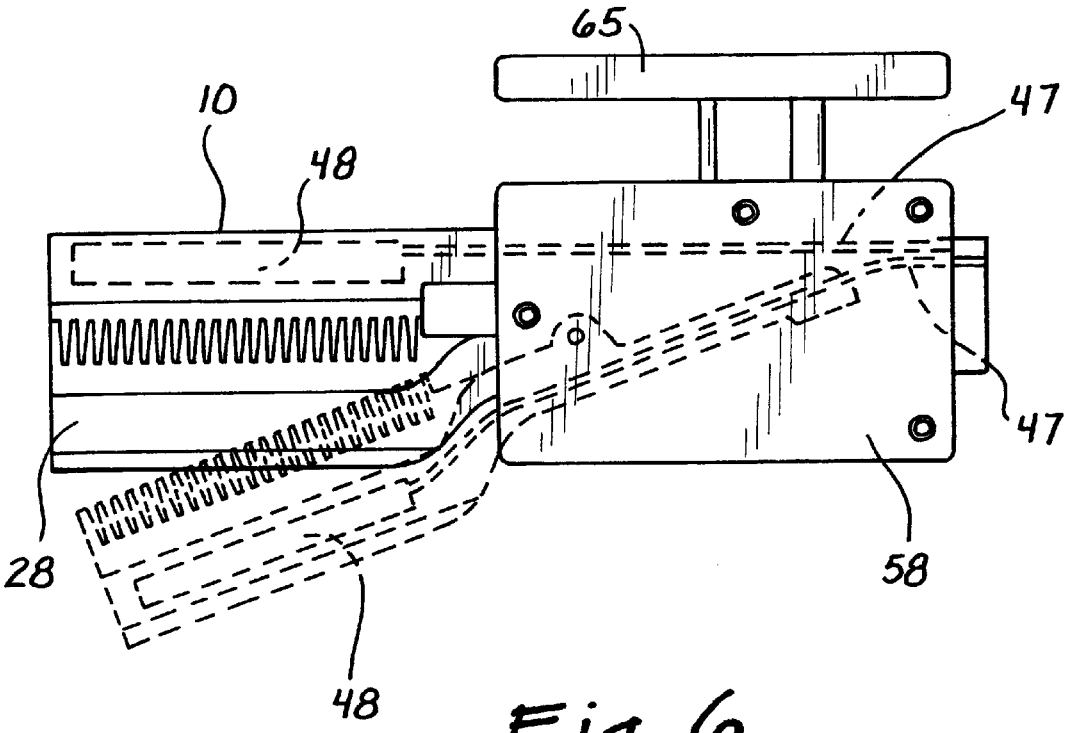
Fig. 6

APPARATUS AND METHOD FOR HAIR EXTENSION

BACKGROUND OF THE INVENTION

I. Field of the Invention

This invention pertains to an improved apparatus and a method for hair extension. More specifically, the invention concerns an apparatus and method for lengthening the hair of a person by attaching extra hair to existing hair.

II. Description of the Prior Art

Attaching natural or synthetic hair extensions to a person's existing hair is popular for creating a fuller volume of hair and for creating a longer head of hair. Conventionally hair extension is either attached directly to a person's scalp or to the existing hair near the scalp using a glue. A hair dryer is used to blow air to the points of attachment to speed the hardening of the glue. An inconvenience with this conventional method is that the glue can often cause irritation when applied to the scalp. Also, the glue has a tendency to start flaking over time, which causes a dandruff-like appearance. Also, the conventional method is a timely process since hair extensions must be attached one at a time.

Other methods of hair attachment are taught in U.S. Pat. No. 5,072,745 issued to Cheh and U.S. Pat. No. 4,934,387 issued to Megna. Cheh teaches a hair extension process in which hot melt adhesive is applied to connect hair extension to existing hair near the scalp. Thereafter, a sealant is applied over the adhesive. The disadvantage of Cheh is that one strand or one group of strand is connected to an extension of hair at one time. Thus, the process can be lengthy if when multiple extensions have to be attached.

Megna teaches a hair extension process in which supplemental hair is aligned with natural hair, attached using a thermoplastic glue, and intertwined together to permit binding. Once again, this can be a lengthy process when multiple bundles of supplemental hair have to be attached.

Thus, it is a primary objective of the present invention to provide an apparatus for attaching supplemental hair to existing hair which is easy to operate. It is another objective of the present invention to provide a method of lengthening existing hair using supplemental hair.

SUMMARY OF THE INVENTION

This present invention overcomes the disadvantages of the prior art and provides an apparatus and method for the attachment of supplemental hair to existing hair. The apparatus of the present invention comprises a first comb member having a handle attached at a back end thereof and a second comb member hingeably or pivotally attached thereto. A row of first teeth extends from the first comb member, and a row of second teeth extends from the second comb member. The second comb member is positioned to move interchangeably between a closed position and an open position. In the open position, the row of second teeth is spaced apart from the row of first teeth. When moved to the closed position, the row of second teeth moves to fit in between the row of first teeth. A lever means can be utilized to move the second comb member into the corresponding closed and open positions. A heating member which connects to and provides heat to one or both of the first comb member and second comb member is provided in the apparatus. A heating rod can also be placed within one or both of the first comb member and second comb member which connects to and receives heat from the heating member.

In an alternative embodiment, the first comb member and second comb member both extend parallel from a housing member. The second comb member can be pushed and pulled to move the second comb member interchangeably between the closed and open positions.

The present invention is utilized in a process to attach supplemental hair to existing natural hair of a person's head. The method uses rows of supplemental hair wherein each row of supplemental hair is pre-attached to a band member. An adhesive member is pre-hardened on each row of supplemental hair at a predetermined distance near the band member. With the second comb member in the open position, the rows of supplemental hair strands of natural hair are placed between each tooth of the row of first teeth. The second comb member is moved to the closed position for a predetermined period of time long enough to allow the pre-hardened adhesive to melt sufficiently to adhere the rows supplemental hairs. Once the supplemental and natural hairs are removed from the apparatus, the adhesive hardens to form a secure connection.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment in which:

FIG. 6 is a side view of a second embodiment of the present invention;

FIG. 7 is a side cross-sectional view of FIG. 6; and,

DESCRIPTION OF THE PREFERRED EMBODIMENT

Figure 1:
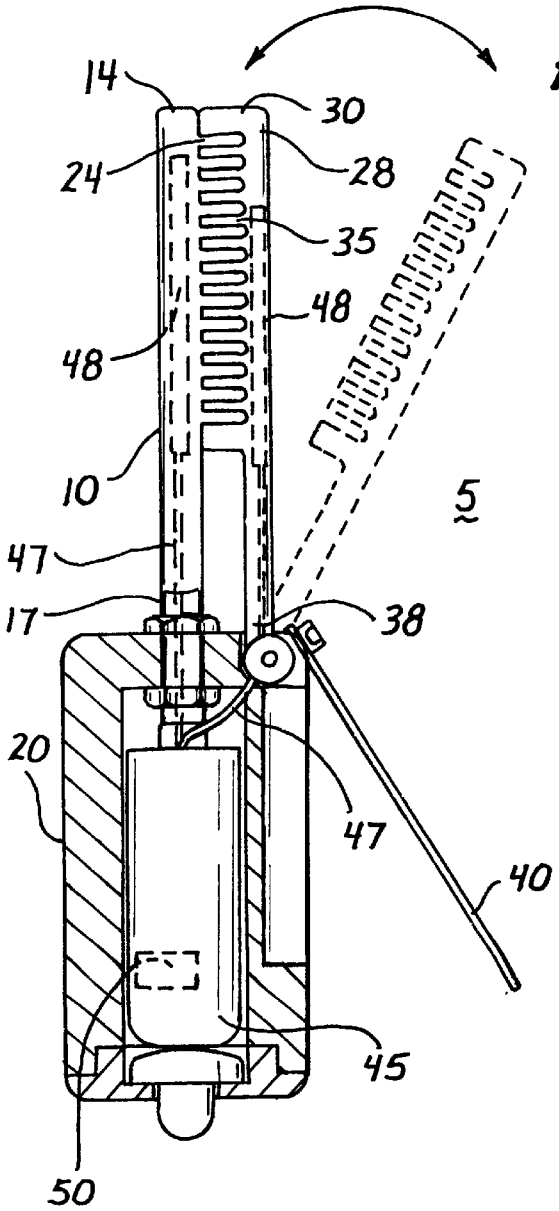
FIG. 1 is a side cross-sectional view of the present invention.
Figure 2:
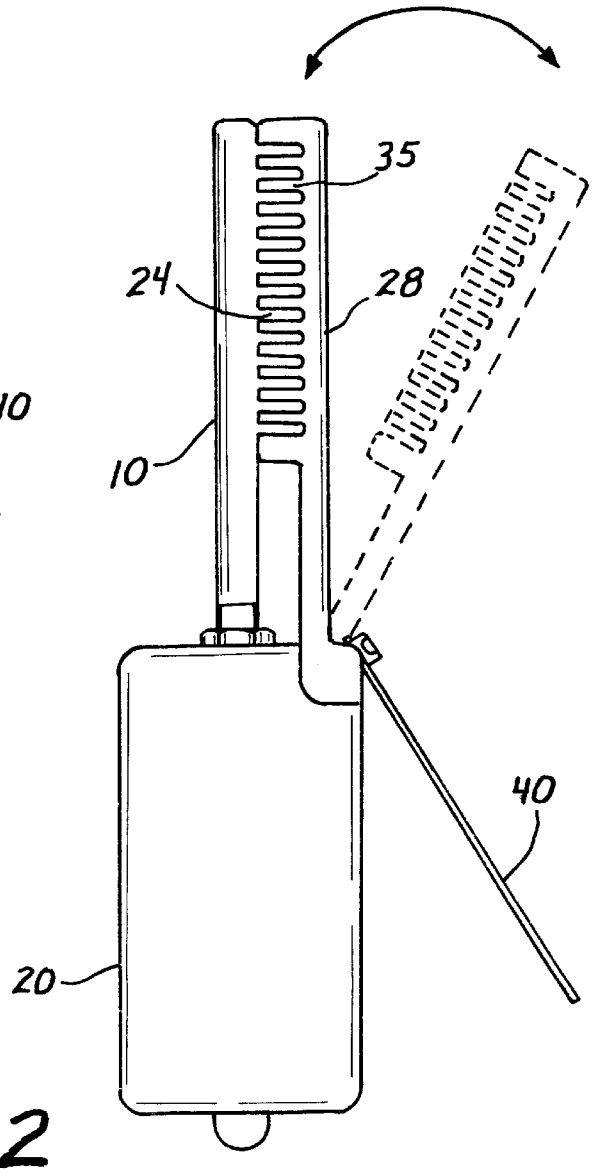
FIG. 2 is a side view of the present invention.
Figure 3:
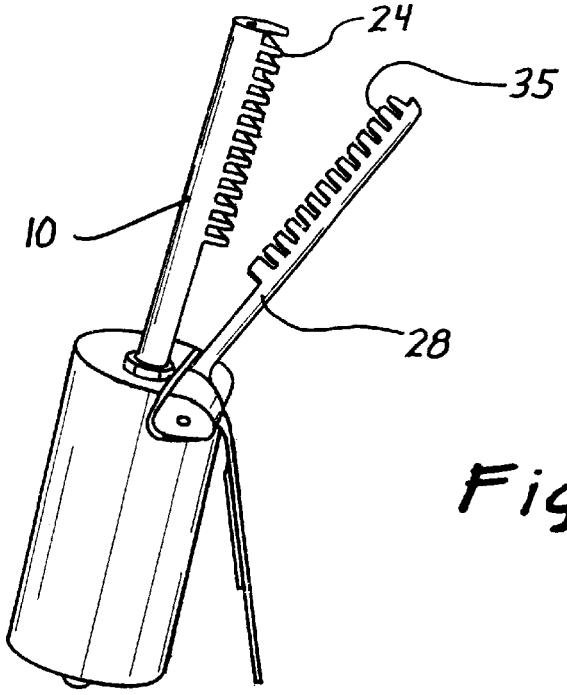
FIG. 3 is a perspective view of the present invention.

FIGS. 1 through 4 shows the apparatus 5 of the present invention which comprises a first comb member 10 having a front end 14, a back end 17, and a handle 20 attached at the back end 17. A row of first teeth 24 extends from the first comb member 10. A second comb member 28 having a front end 30 and a back end 38 is hingeably attached to the first comb member 10. A row of second teeth 35 extends from the second comb member 28. The second comb member 28 moves interchangeably from a closed position (illustrated in FIG. 5) and an open position (illustrated in FIG. 3). In the open position, the row of second teeth 35 is spaced apart from the row of first teeth 24. In the closed position, the row of second teeth 35 is placed to fit in between the row of first teeth 24. A lever 40 is connected near the back end 38 of the second comb member 28. Pushing and releasing the lever 40 moves the second comb member 28 into the corresponding closed and open positions.

The apparatus 5 further comprises a heating member 45 which connects to and provides heat to one or both of the first comb member 10 and second comb member 28. The heating member 45 can be any one of the type known in the art to provide heat to a heat conducting material. The heating member can be a heating coil receiving electricity from an electrical cord. A heating rod 48 can be placed within one or both of the first comb member 10 and second comb member 28 which connects to and receives heat from the heating member 45. For the embodiment having a heating rod 48, the heating member 45 can simply be an electrical cord 47 connecting to the heating rod. The first comb member 10, second comb member 28, row of first teeth 24, row of second teeth 35, and heating rod 48 should be made of a heat conducting material. For regulating the temperature produced by the heating member, a thermostat 50 can be placed within or connecting to the heating member 45.

In a second embodiment as shown in FIGS. 6 and 7, the apparatus 5 comprises a first comb member 10 extending from a housing member 58. A row of first teeth 24 extends from the first comb member 10. A second comb member 28 having an outer half 52 extending from the housing member 58 and an inner half 54 extending within the housing member 58 is pivotally connected within the housing member 58 at a pivot point 55 located adjacent the first comb member 10. A row of second teeth 35 extends from the outer half 52 of the second comb member 28. The second comb member 28 pivots at the pivot point 55 to move interchangeably between a closed position and an open position (indicated by the dotted lines for the second comb member 28 in FIGS. 6 and 7). The apparatus 5 includes means to move the second comb member 28 interchangeably between the closed and open positions. A heating member 45 also connects to and provides heat to one or both of the first comb member 10 and second comb member 28. A heating rod 48 can be placed within one or both of the first comb member 10 and second comb member 28 which connects to and receives heat from the heating member 45. The first comb member 10, the outer half 52 of the second comb member 28, row of first teeth 24, row of second teeth 35, and heating rod 48 should be made of a heat conducting material. For regulating the temperature produced by the heating member, a thermostat 50 can be placed within or connecting to the heating member 45.

In the second embodiment as shown in FIGS. 6 and 7, the means to move the second comb member 28 interchangeably between the closed and open positions includes a coiled spring member 57 and one or more rods 60. The spring member 57 is placed within the housing member 58 adjacent the inner half 54 of the second comb member 28. The spring member 57 has an arm 59 extending therefrom which is biased to urge the second comb member 28 to pivot to the open position. To push the second comb member 28 to the closed position, one or more rods 60 are slideably engaged within the housing member 58. Each rod 60 has a grip end 62 attached to a grip member 65 located outside the housing member 58 and an opposed inner end 68. Pushing the grip member 65 towards the housing member 58 pushes the one or more rods 60 into the inner half 54 of the second comb member 28 causing the second comb member 28 to pivot into the closed position. One or more of the rods 60 can be connected to the inner half 54 of the second comb member 28 so that by pulling the grip member 65 away from the housing member 58, the second comb member 28 could be pulled away from the first comb member 10 into the open position.

Figure 8:
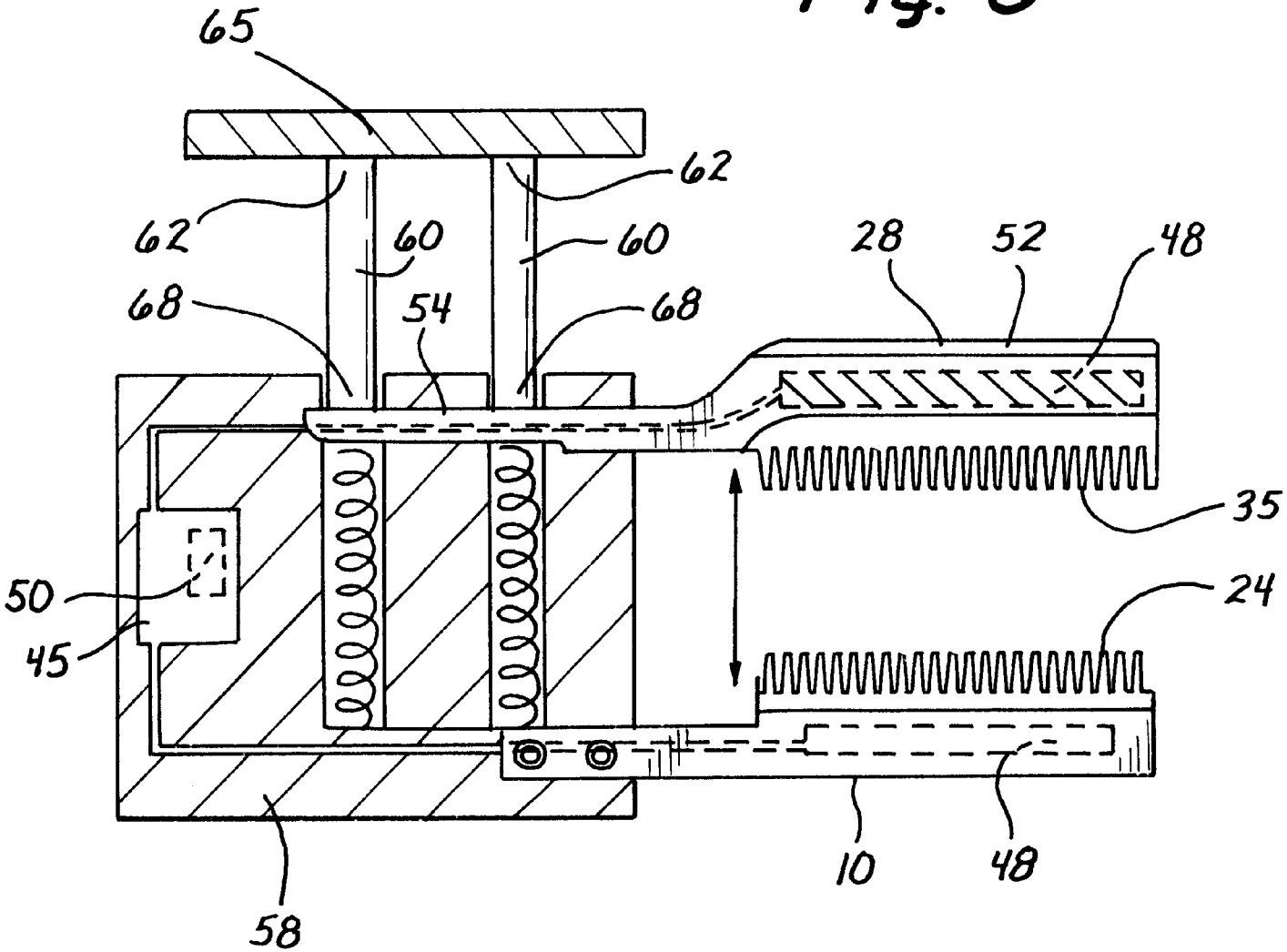
FIG. 8 is a side cross-sectional view of a third embodiment of the present invention.

A third embodiment as shown in FIG. 8 is similar to the second embodiment except that instead of being pivotally connected at a pivot point, the second comb member 28 is moveably positioned within the housing member 58 and is parallel to the first comb member 10. Also, the means to move the second comb member 28 interchangeably between the closed and open positions varies from that of the second embodiment. In the third embodiment one or more spring member 70 is placed within the housing member 58 adjacent to the inner half 54 of the second comb member 28. The spring member 70 is biased to urge the second comb member 28 away from the first comb member 10 to the open position. To push the second comb member 28 to the closed position, the grip member 65 is pressed toward the housing member 58, which in turn pushes the one or more rods 60 into the inner half 54 of the second comb member 28. One or more of the rods 60 can be connected to the inner half 54 of the second comb member 28 so that by pulling the grip member 65 away from the housing member 58, the second comb member 28 could be pulled away from the first comb member 10.

Figure 4:
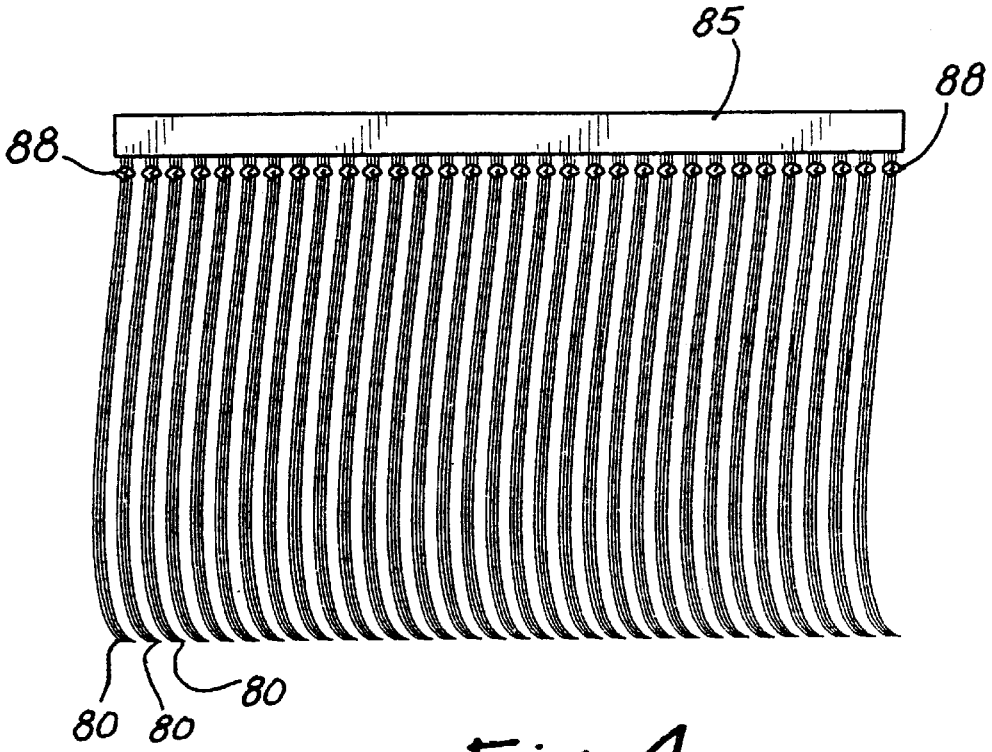
FIG. 4 is a view of the supplemental hair attached to a band which is used to for attachment to existing natural hair using the present invention.
Figure 5:
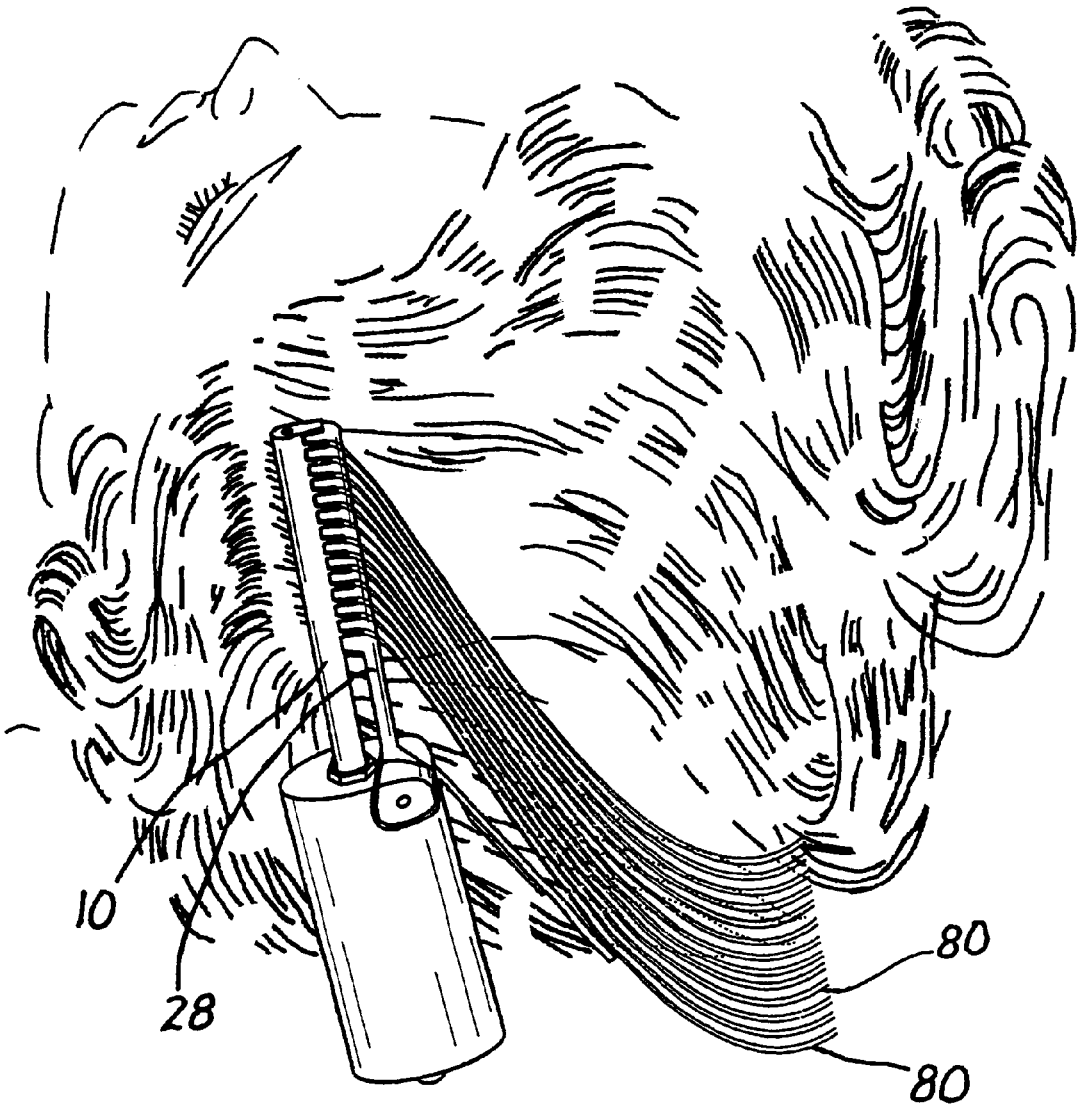
FIG. 5 is a view of the present invention being used to attach the supplemental hair of FIG. 4 to existing natural hair.

The present invention also provides a process for attaching supplemental hair to existing natural hair of a person's head utilizing the apparatus 5 of the present invention. The process comprises providing rows of supplemental hair 80 with each row of supplemental hair 80 connecting to a band member 85. As illustrated in FIG. 4, a predetermined amount of adhesive member 88 is pre-hardened on each row of supplemental hair 85 at a predetermined distance from the band member 85. The second comb member 28 is placed in the open position. The rows of supplemental hair 80 is placed between each tooth of the row of first teeth 10. The strands of natural hair, at a predetermined distance near the scalp of the individual, is also placed between each tooth of the row of first teeth 10. Thereafter, the second comb member 28 is moved to the closed position for a predetermined period of time long enough to allow the pre-hardened adhesive to melt sufficiently to adhere the rows supplemental hairs 80 to the natural hairs as illustrated in FIG. 5. The second comb member 28 is then moved to the open position to remove the now attached supplemental 80 and natural hairs from the apparatus. Next, the attached supplemental hairs 80 is severed from the band member 85.

While a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claim which will follow.

What is claimed is:

1. An apparatus for hair attachment comprising:

a first comb member having a front end, a back end, and a handle attached at said back end;

a single row of first teeth extending from said first comb member, said first teeth made of a durable rigid material;

a second comb member hingeably attached to said first comb member, said second comb member having a front end and a back end;

said second comb member moving interchangeably from a closed position and an open position;

a single row of second teeth extending from said second member, said row of second teeth positioned to face said row of first teeth, said second teeth made of a durable rigid material;

whereby in said open position, said row of second teeth is spaced apart from and facing said row of first teeth;

whereby in said closed position, said row of second teeth is placed to fit in between said row of first teeth in a parallel single row alignment; and, a heating member attached to said first comb member for providing heat to said first comb member.

2. The apparatus as described in claim 1 further comprising a lever attached to said second comb member for moving said second comb member interchangeably between said closed and open positions.

3. The apparatus as described in claim 1 wherein said heating member also connects to said second comb member to provide heat to said second comb member.

4. The apparatus as described in claim 1 further comprising a first heating rod disposed within said first comb member, said first heating rod connecting to said heating member.

5. The apparatus as described in claim 3 further comprising a second heating rod disposed within said second comb member, said second heating rod connecting to said heating member.

6. An apparatus for hair attachment comprising:

a housing member;

a first comb member extending from said housing member;

a single row of first teeth extending from said first comb member, said first teeth made of a durable rigid material;

a second comb member having an outer half extending from said housing member and an inner half extending within said housing member, said second comb member being pivotally connected to said housing member at a pivot point adjacent said first comb member;

a single row of second teeth extending from said outer half of said second comb member, said row of second teeth facing said row of first teeth, said second teeth made of a durable and rigid material;

said second comb member pivoting at said pivot point to move interchangeably between a closed position and an open position;

whereby in said open position, said row of second teeth is spaced from and facing said row of first teeth;

whereby in said closed position, said row of second teeth is placed to fit in between said row of first teeth in parallel alignment;

a means for pushing said inner half of said second comb member to pivot said second comb member to said closed position; and, a heating member attached to said first comb member for providing heat to said first comb member.

7. The apparatus as described in claim 6 further comprising a spring means disposed within said housing member adjacent said second comb member, said spring means biased to urge said second comb member to pivot to said open position.

8. The apparatus as described in claim 6 wherein said means for pushing said inner half of said second comb member comprises:

one or more rods slideably engaged within said housing member;

each rod having a grip end attached to a grip member disposed outside said housing member and an opposed inner end; and, whereby pushing said grip end towards said housing member pushes said one or more rods into said inner half of said second comb member causing said second comb member to pivot into said closed position.

9. The apparatus as described in claim 6 wherein said heating member also connects to said second comb member to provide heat to said second comb member.

10. The apparatus as described in claim 6 further comprising a first heating rod disposed within said first comb member, said first heating rod connecting to said heating member.

11. The apparatus as described in claim 9 further comprising a second heating rod disposed within said outer half of said second comb member, said second heating rod connecting to said heating member.

12. The apparatus as described in claim 6 further comprising a thermostat connecting to said heating member for regulating the amount of heat provided by said heating member.

13. An apparatus for hair attachment comprising:

a housing member;

a first comb member extending from said housing member;

a single row of first teeth extending from said first comb member, said first teeth made of a durable and rigid material;

a second comb member having an outer half extending from said housing member and an inner half slideably disposed within said housing member, said second comb member being moveably disposed within said housing member and being parallel to said first comb member;

a single row of second teeth extending from said outer half of said second comb member, said row of second teeth facing said row of first teeth, said second teeth made of a durable and rigid material;

said second comb member moving both toward and away from said first comb member between a closed position and an open position;

whereby in said open position, said row of second teeth is spaced apart from and facing said row of first teeth;

whereby in said closed position, said row of second teeth is placed to fit in between said row of first teeth in parallel alignment with each tooth from said first and second teeth sequentially fitting interchangeably between each other one after the other;

a means for pushing and pulling said second comb member interchangeably between said open said closed position; and, a heating member attached to said first comb member for providing heat to said first comb member.

14. The apparatus as described in claim 13 further comprising a spring means disposed within said housing member adjacent said second comb member, said spring means biased to urge said second comb member away from said first comb member and to said open position.

15. The apparatus as described in claim 13 wherein said means for pushing said inner half of said second comb member comprises:

one or more rods slideably disposed within said housing member;

each rod having a grip end attached to a grip member and an opposed inner end, said grip member being disposed outside said housing member; and, whereby pushing said grip end towards said housing member pushes said one or more rods into said inner half of said second comb member causing said second comb member to move into said closed position.

16. The apparatus as described in claim 13 wherein said heating member also connects to said second comb member to provide heat to said second comb member.

17. The apparatus as described in claim 13 further comprising a first heating rod disposed within said first comb member, said first heating rod connecting to said heating member.

18. The apparatus as described in claim 16 furtherer comprising a second heating rod disposed within said second comb member, said second heating rod connecting to said heating member.

19. The apparatus as described in claim 13 further comprising a thermostat connecting to said heating member for regulating the amount of heat provided by said heating member.

20. A process for attaching supplemental hair to existing natural hair of a person's head comprising the steps of:

providing an apparatus for hair attachment comprising:

a first comb member having a front end, a back end, and a handle attached at said back end;

a row of first teeth extending from said first comb member;

a second comb member hingeably attached to said first comb member, said second comb member having a front end and a back end;

said second comb member moving interchangeably between a closed position and an open position;

a row of second teeth extending from said second member;

whereby in said open position, said row of second teeth is spaced apart from said row of first teeth;

whereby in said closed position, said row of second teeth is placed to fit in between said row of second teeth;

a heating member attached to one or both of said first comb member and second comb member for providing heat to one or both of said first comb member and second comb member;

a lever attached to said second comb member for moving said second comb member interchangeably between said closed and open positions;

providing rows of supplemental hair with each row of supplemental hair connecting to a band member;

applying a predetermined amount of pre-hardened adhesive member to each row of supplemental hair at a predetermined distance from said band member;

placing said second comb member in said open position;

placing said rows of supplemental hair between said first teeth of said apparatus;

placing strands of natural hair between said first teeth of said apparatus;

moving said second comb member to said closed position for a predetermined period of time long enough to allow said pre-hardened adhesive to melt sufficiently to adhere said supplemental hairs to said natural hairs;

moving said second comb member to said open position; and, removing said supplemental and natural hairs from said first comb member.

* * * * *